US008087959B2

(12) United States Patent
Hsu

(10) Patent No.: US 8,087,959 B2
(45) Date of Patent: Jan. 3, 2012

(54) DETACHABLE SWIM FIN

(76) Inventor: Chien-Cheng Hsu, Dongguan (CN)

( * ) Notice: Subject to any disclaimer, the term of this patent is extended or adjusted under 35 U.S.C. 154(b) by 237 days.

(21) Appl. No.: 12/558,282

(22) Filed: Sep. 11, 2009

(65) Prior Publication Data

US 2011/0065343 A1 Mar. 17, 2011

(51) Int. Cl.

| | |
|---|---|
| ***A63B 31/11*** | (2006.01) |
| *A41F 1/00* | (2006.01) |
| *A43C 11/00* | (2006.01) |
| *A44B 11/25* | (2006.01) |
| *A44B 17/00* | (2006.01) |
| *A44B 1/04* | (2006.01) |

(52) U.S. Cl. ..... 441/63; 24/614; 24/701

(58) Field of Classification Search ..... 441/55, 441/60–64; 24/3.11, 3.12, 614, 615, 701, 24/163 R, 165, 313, 190

See application file for complete search history.

(56) References Cited

U.S. PATENT DOCUMENTS

| | | | | |
|---|---|---|---|---|
| 4,795,385 | A * | 1/1989 | Matsuoka | 441/64 |
| 5,766,050 | A * | 6/1998 | Maggi | 441/63 |
| 6,341,383 | B1 * | 1/2002 | Beltrani | 2/452 |
| 6,374,467 | B1 * | 4/2002 | Chen | 24/163 R |
| 6,398,604 | B1 * | 6/2002 | Kawashima et al. | 441/64 |
| 2005/0153607 | A1 * | 7/2005 | Burns et al. | 441/63 |

* cited by examiner

*Primary Examiner* — Lars A Olson
*Assistant Examiner* — Anthony Wiest

(57) ABSTRACT

A detachable swim fin includes a foot pocket and a fin blade. The fin blade is movably connected to the foot pocket through a locking buckle mechanism. With the detachable design of the fin blade and the foot pocket, the present invention provides an amphibious function. When they are detached, the foot pocket is capable of protecting the foot when walking on land, like a beach shoe or a fishing shoe. When they are assembled, the present invention is used as a swim fin. When going out, the user could take apart the swim fin for carrying conveniently and flexibly. This provides a compact and light design.

1 Claim, 4 Drawing Sheets

DETACHABLE SWIM FIN

BACKGROUND OF THE INVENTION

1. Field of the Invention

The present invention relates to a sports article for diving, and more particularly to a detachable swim fin that has multiple functions for swim or diving.

2. Description of the Prior Art

A swim fin is important equipment for diving. Swim fins are generally put on once the swimmer is in the water, and they are popular as they increase the water-pushing power of the swimmer's legs, thereby increasing the swimmer's speed through the water and helping the swimmer stay afloat more easily. A conventional swim fin includes a foot pocket and a web. The foot pocket is adapted for the diver's foot and the web is adapted to provide propulsion when in water. The foot pocket is integrally formed with the web through a pair of reinforcement ribs provided at two sides of the swim fin, namely, the front section and the rear section of the swim fin are inseparable. This structure has steady properties when in use. But, this product only has a single purpose to be used in water. When walking on land, it is not useful. Particularly, the length of the swim fin is long. It is not convenient for the user to take it along.

SUMMARY OF THE INVENTION

The primary object of the present invention is to overcome the above-mentioned shortcomings and provide a multi-function detachable swim fin for carrying conveniently.

Another object of the present invention is to provide a detachable swim fin, which is assembled or disassembled with ease and provides a better lock function.

According to the present invention, there is provided a detachable swim fin, comprising a foot pocket and a fin blade, the fin blade being movably connected to the foot pocket through a locking buckle mechanism.

Preferably, the fin blade includes a pair of reinforcement ribs extending from two sides thereof, the locking buckle mechanism including a pair of first connecting buckles and a pair of second connecting buckles to engage with the pair of first connecting buckles, the pair of first connecting buckles being fixed to respective rear ends of the pair of reinforcement ribs of the fin blade, the pair of second connecting buckles being mounted on two sides of the foot pocket.

Preferably, the foot pocket includes a shoe body made of soft rubber and a holding base made of hard rubber, the holding base being bound to the shoe body, the pair of second connecting buckles is mounted on the holding base.

Preferably, the foot pocket has a pair of sides each formed with an engaging aperture, an engaging button, and a stop block, each of the pair of second connecting buckles including an engaging protrusion, an engaging hole, and a limit slot, the engaging hole consisting of a large hole and a small hole which are interconnected with each other, the engaging button going through the large hole and sliding in the small hole when mounting the second connecting buckle, the engaging protrusion engaging with the engaging aperture, the stop block being confined within the engaging slot.

Preferably, each of the pair of first connecting buckles includes a main body coupled to one of the pair of reinforcement ribs and two resilient arms extending from the main body, the two resilient arms each having a front end formed with a hook, the pair of second connecting buckles each including a housing, the housing being formed with a pair of grooves at two sides thereof for engaging with the hook.

Preferably, the fin blade has a rear end provided with a plurality of limit ribs disposed between the pair of reinforcement ribs, the foot pocket having a front bottom formed with a plurality of insertion troughs corresponding to the limit ribs, the limit ribs being inserted in the insertion troughs.

Preferably, the limit ribs each have a base portion and an extension end, the limit ribs each having a thickness which is gradually reduced from the base portion to the extension end.

Accordingly, with the detachable design of the fin blade and the foot pocket, the present invention provides an amphibious function. When they are detached, the foot pocket is capable of protecting the foot when walking on land, like a beach shoe or a fishing shoe. When they are assembled, the present invention is used as a swim fin. When going out, the user could take apart the swim fin for carrying conveniently and flexibly. This provides a compact and light design. In addition, with the locking buckle mechanism composed of two connecting buckles, the present invention provides a quick connection. Besides, the present invention has a number of lock designs so that the fin blade and the foot pocket are connected firmly without influencing its function.

DETAILED DESCRIPTION OF THE PREFERRED EMBODIMENT

Embodiments of the present invention will now be described, by way of example only, with reference to the accompanying drawings.

Figure 1:
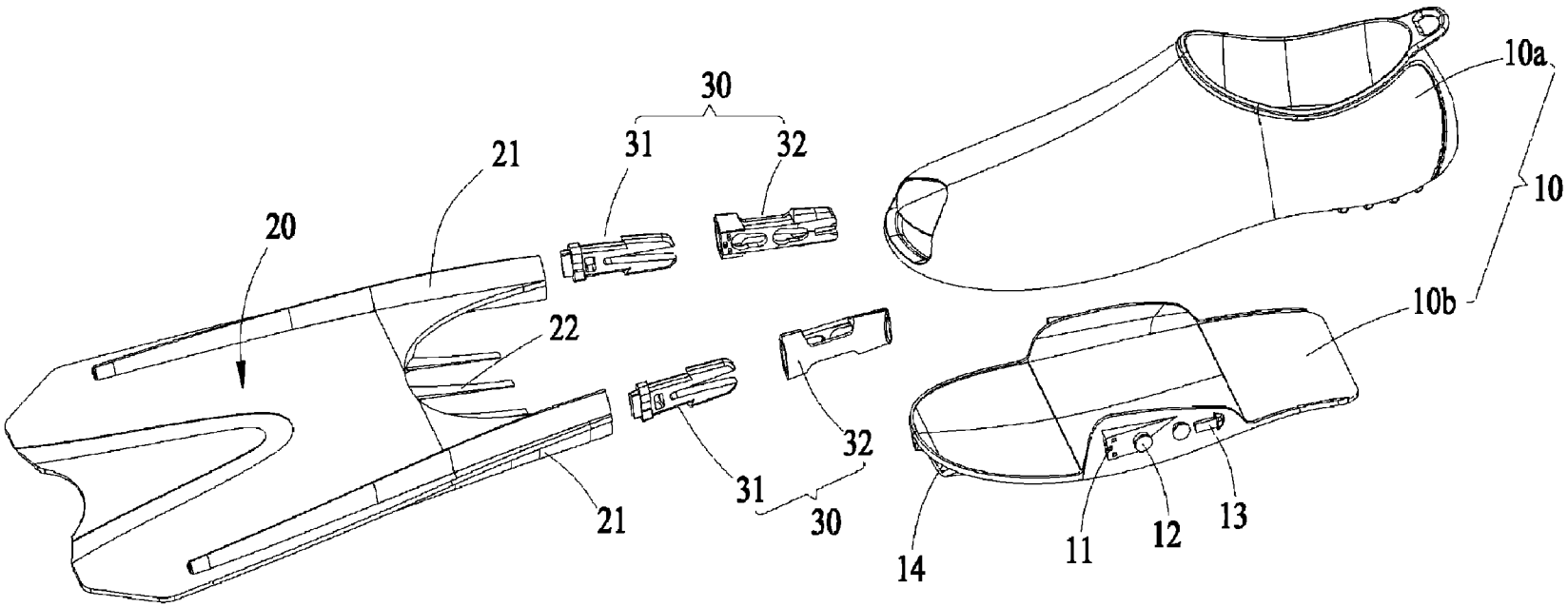
FIG. 1 is an exploded view according to a preferred embodiment of the present invention.
Figure 2:
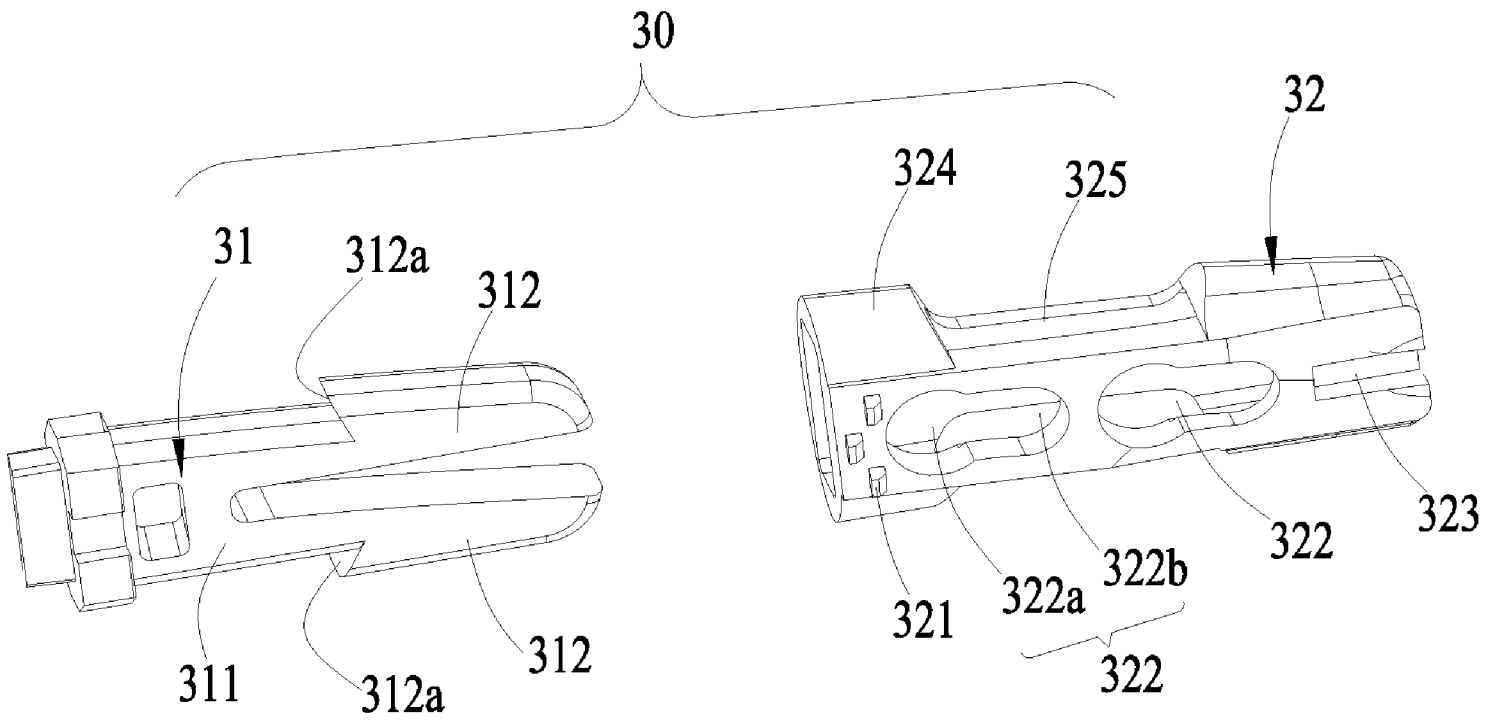
FIG. 2 is an enlarged view of a locking buckle mechanism according to the preferred embodiment of the present invention.
Figure 3:
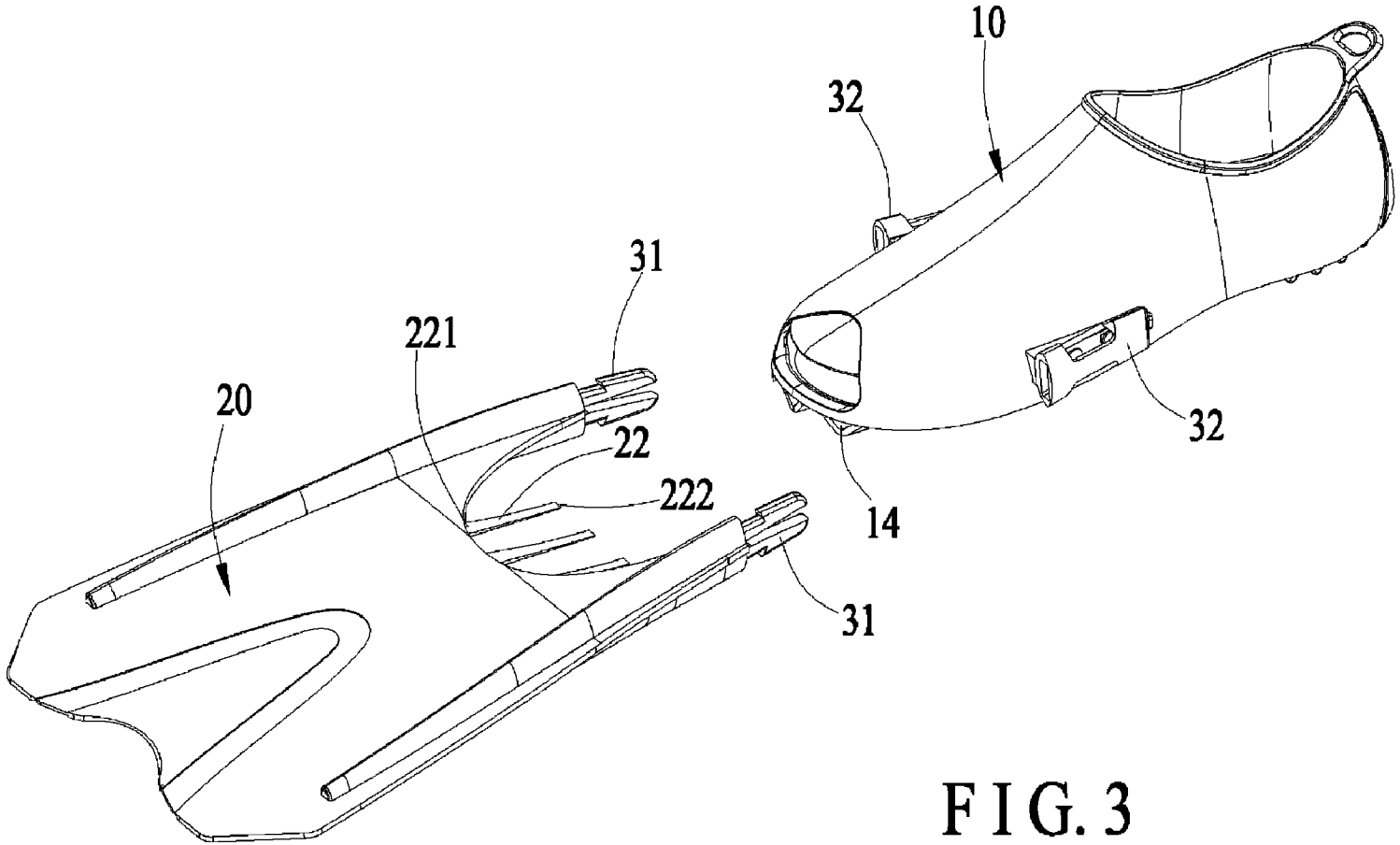
FIG. 3 is an assembled view of FIG. 1.
Figure 4:
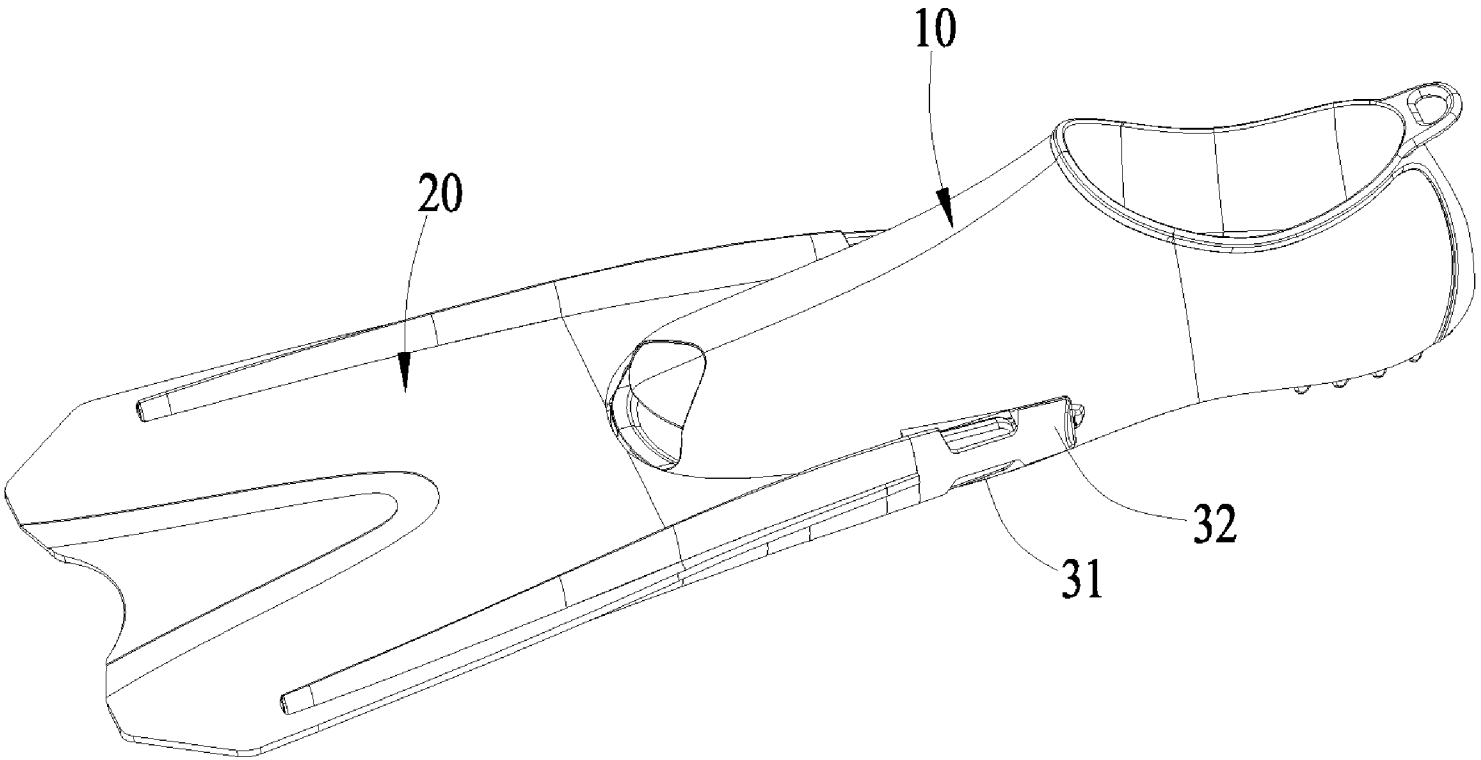
FIG. 4 is a perspective view according to the preferred embodiment of the present invention.

As shown in FIGS. 1 through 4, a detachable swim fin according to a preferred embodiment of the present invention comprises a foot pocket 10 and a fin blade 20. The fin blade 20 is movably connected to the foot pocket 10 through a locking buckle mechanism 30.

The fin blade 20 includes a pair of reinforcement ribs 21 extending from two sides thereof. The locking buckle mechanism 30 includes a pair of first connecting buckles 31 and a pair of second connecting buckles 32 which is engaged with the pair of first connecting buckles 31. The pair of first connecting buckles 31 is fixed to respective rear ends of the pair of reinforcement ribs 21 of the fin blade 20. The pair of second connecting buckles 32 is mounted on two sides of the foot pocket 10.

The foot pocket 10 includes a shoe body 10*a* made of soft rubber and a holding base 10*b* made of hard rubber. The holding base 10*b* is bound to the shoe body 10*a*. The pair of second connecting buckles 32 is mounted on the holding base 10*b*.

The holding base 10*b* of the foot pocket 10 has a pair of sides each formed with an engaging aperture 11, an engaging button 12, and a stop block 13. Each of the pair of second connecting buckles 32 includes an engaging protrusion 321, an engaging hole 322, and a limit slot 323. The engaging hole 322 consists of a large hole 322*a* and a small hole 322*b* which are interconnected with each other. When the second connecting buckle 32 is mounted to the holding base 10*b*, the engaging button 12 will go through the large hole 322*a* and then slide in the small hole 322*b*; the engaging protrusion 321 will engage with the engaging aperture 11; and the stop block 13 is confined within the engaging slot 323. Thus, the second connecting buckle 32 is locked on the foot pocket 10 firmly.

Each of the pair of first connecting buckles 31 includes a main body 311 and two resilient arms 312 extending from the main body 311. The main body 311 is coupled to the reinforcement rib 21 of the fin blade 20. Each of the two resilient arms 312 has a front end formed with a hook 312*a*. Each of the pair of second connecting buckles 32 includes a housing 324. The housing 324 is formed with a pair of grooves 325 at two sides thereof. When in use, the two resilient arms 312 are inserted in the housing 324 with the hooks 312*a* to engage with the grooves 325. When not in use, the two resilient arms 312 are pressed inward so that the hooks 312*a* disengage from the grooves 325 and the first connecting buckle 31 is pulled out. Accordingly, the first connecting buckle 31 and the second connecting buckle 32 are locked or unlocked in a quick manner.

Furthermore, the fin blade 20 has a rear end provided with a plurality of limit ribs 22 disposed between the pair of reinforcement ribs 21. The foot pocket 10 has a front bottom formed with a plurality of insertion troughs 14 corresponding to the limit ribs 22. The limit ribs 22 are inserted in the insertion troughs 14 such that the fin blade 20 and the foot pocket 10 are assembled more steadily. Each of the limit ribs 22 has a base portion 221 and an extension end 222. The thickness of the limit rib 22 is gradually reduced from the base portion 221 to the extension end 22 so that the limit rib 22 is connected to the insertion trough 14 tightly.

Accordingly, with the detachable design of the fin blade and the foot pocket, the present invention provides an amphibious function. When they are detached, the foot pocket is capable of protecting the foot when walking on land, like a beach shoe or a fishing shoe. When they are assembled, the present invention is used as a swim fin. When going out, the user could take apart the swim fin for carrying conveniently and flexibly. This provides a compact and light design. In addition, with the locking buckle mechanism composed of two connecting buckles, the present invention provides a quick connection. Besides, the present invention has a number of lock designs so that the fin blade and the foot pocket are connected firmly without influencing its function.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A detachable swim fin, comprising a foot pocket and a fin blade, the fin blade being movably connected to the foot pocket through a locking buckle mechanism, wherein the fin blade includes a pair of reinforcement ribs extending from two sides thereof, the locking buckle mechanism including a pair of first connecting buckles and a pair of second connecting buckles to engage with the pair of first connecting buckles, the pair of first connecting buckles being fixed to respective rear ends of the pair of reinforcement ribs of the fin blade, the pair of second connecting buckles being mounted on two sides of the foot pocket, the foot pocket has a pair of sides each formed with an engaging aperture, an engaging button, and a stop block, each of the pair of second connecting buckles including an engaging protrusion, an engaging cavity, and a limit slot, the engaging cavity consisting of two openings of different sizes which are interconnected with each other, the engaging button going through one of the two openings and sliding in the other of the two openings when mounting the second connecting buckle, the engaging protrusion engaging with the engaging aperture, and the stop block being confined within the limit slot.

* * * * *